United States Patent [19]

Benthem et al.

[11] 4,039,701

[45] Aug. 2, 1977

[54] METHOD OF METALLIZING A SCREEN HAVING A LUMINESCENT LAYER

[75] Inventors: Harm Gerrit Benthem; Cornelis van Straten, both of Eindhoven, Netherlands

[73] Assignee: U.S. Philips Corporation, New York, N.Y.

[21] Appl. No.: 597,425

[22] Filed: July 21, 1975

Related U.S. Application Data

[63] Continuation of Ser. No. 293,118, Sept. 28, 1972, abandoned.

[30] Foreign Application Priority Data

Oct. 2, 1971 Netherlands ..... 7113565

[51] Int. Cl.[2] ..... B05D 5/06

[52] U.S. Cl. ..... 427/69; 427/64; 427/124; 427/166; 427/237; 427/250; 427/255; 427/266; 427/270; 427/299; 427/404; 427/407 A; 313/466

[58] Field of Search ..... 427/162, 166, 226, 299, 427/250, 255, 270, 427, 233, 237, 236, 404, 407, 69, 64, 124; 313/466

[56] References Cited

U.S. PATENT DOCUMENTS

| | | | |
|---|---|---|---|
| 2,751,515 | 6/1956 | Peper | 427/64 |
| 3,473,942 | 10/1969 | Magill et al. | 427/223 |
| 3,674,550 | 7/1972 | Mallory | 427/98 |

OTHER PUBLICATIONS

Plasler, H. J. *Blast Cleaning and Allied Processes* London, Industrial Newspaper Ltd. vol. II, 1973, pp. 354–357, 368 & 369.

*Primary Examiner*—Ronald H. Smith
*Assistant Examiner*—Janyce A. Bell
*Attorney, Agent, or Firm*—Frank R. Trifari

[57] ABSTRACT

A method of metallizing a screen with a luminescent layer. The method comprises the following steps: providing a film that can be fired. Blasting parts of the film projecting beyond the luminescent layer with a fine-granular material, metallizing the film, firing the film. The said blasting prevents blisters and chips from forming in the metallization.

2 Claims, 1 Drawing Figure

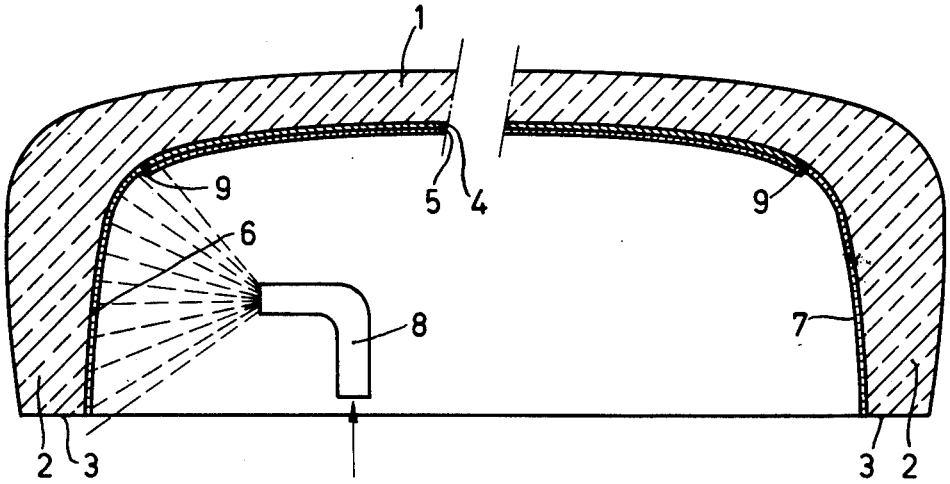
1
9
5
4
9
6
8
7
2
3
3
2

METHOD OF METALLIZING A SCREEN HAVING A LUMINESCENT LAYER

This is a continuation of application Ser. No. 293,118, filed Sept. 28, 1972, now abandoned.

The invention relates to a method of metallizing a screen having a luminescent layer, comprising the provision of a film that can be fired, metallization of the film and the firing of said film. The invention furthermore relates to a cathode-ray tube manufactured by this method.

A screen having a luminescent layer is used, for example, in a television picture display tube. The screen in such a tube is formed by a glass face plate. On this face plate is provided on the inside of the tube a luminescent layer which is scanned by one or more electron beams. The luminescent material emits light under the influence of the one or more electron beam and in this manner picture display is obtained in a universally known manner. The picture is monochromatic when a homogeneous layer of one type of luminescent material is provided on the face plate. The picture is coloured when the luminescent layer consists of discrete regions of, for example, materials luminescing in three primary colours by means of which a naturally coloured picture can be displayed which is built up from three primary colours. In television picture display tubes and also in other types of cathode-ray tubes, the luminescent layer is generally provided with a metallisation. This metallisation consists of a very thin metal layer which is permeable to the electrons of an electron beam and which reflects light. Such metallisation has several functions, the most important of which are the supply of a given electric voltage to the luminescent layer and the reflection of light irradiated in directions away from the viewer by the luminescent layer, as a result of which reflection the light intensity of the observed picture is increased. This latter function requires a smooth surface of the metallization on the side of the viewer.

A method of providing such a metallization with a smooth surface is known from the U.S. Pat. No. 2,751,515. In this method, a film that can be fired is first provided on the luminescent layer so as to fill most irregularities of the luminescent screen. The metallization is then vapour-deposited on the smooth surface of the film and the film is then fired, which means that a thermal treatment is used by which the film is evaporated and escapes in a gaseous form through small apertures in metallization. Such small apertures have been formed during the vapour-deposition of the metallization as a result of irregularities of the luminescent layer which have not been filled by the film. The film should therefore be provided with a thickness which is sufficient to obtain a smooth metallization but is not so large that an entirely closed non-porous metallization is obtained since, in that case, the film could not escape during the firing as a result of which blisters are formed in the metallization. However, it cannot be prevented that a part of the film is provided on parts of the screen which are not covered with a luminescent layer and that the parts of the film are also metallized. Since these parts of the film are very smooth due to the lack of an underlying luminescent layer, a non-porous metallization is formed in those places. During firing, blisters and chips are formed in those places, which presents the danger of loose particles occurring in the tube and moreover an ugly appearance of the tube because the blisters and chips are visible to the viewer, particularly in the modern picture tubes in which the edge of the picture screen projects from the anti-implosion means. For that purpose, the above U.S. Pat. indicates as an improvement the provision of a layer of porous material on the relevant parts of the picture screen. This porous material may consist in particular of the same material as the luminescent layer. Apart from the fact that this means a complication in the manufacture of the tube, any improvement is substantially impossible in colour television display tubes since in these tubes the luminescent material is provided by means of a photochemical method in which luminescent material is provided only in those places where it is necessary for displaying the picture. It is therefore usual in practice to polish the film away manually in those places where it projects beyond the luminescent layer prior to metallizing the skin. In connection with the complicated shape of the edge of the luminescent layer, such cleaning away is difficult to mechanize since the edge has to be followed exactly and the luminescent layer may not be damaged. Spouting away with the liquid of the excessive parts of the film, as is proposed in the published German Patent Application No. 1,564,724, has the same drawbacks.

The invention provides a method in which such drawbacks do not occur. The improvement comprises roughening, as by blasting with a fine-granular material, for example, parts of the film projecting from the luminescent layer before the film is metallized. By roughening the film, a slightly porous metallization is obtained, as a result of which no blisters are formed upon firing. Blasting is not a very critical method since the edge of the luminescent layer need not be followed accurately. It has been found that if parts of the film which do cover the luminescent layer are also blasted, the metallization at that area at most becomes slightly more porous but not less suitable for reflecting light.

Residues, if any, of the fine-granular material which remain behind can be blown away. By suitable choice of the material, such residues can also be removed by means of a thermal treatment.

The invention furthermore relates to a cathode-ray tube manufactured according to the above-described method. Such a cathode-ray tube comprises a glass face plate having a metallized luminescent layer and is characterized by a first metallization on an edge of the face plate, the metallization being present directly on the glass.

The invention will be described in greater detail with reference to the FIGURE which shows a face plate of a colour television display tube during the manufacture.

The face plate 1 comprises an upright edge 2. The surface 3 of the edge 2 is accurately flat and in a later stage of the manufacture it is adhered to the cone of the tube. The face plate 1 comprises a luminescent layer 4 which consists of triplets of phosphor dots which luminesce in three primary colours under the influence of the electron beams in the operating tube. The luminescent layer 4 is provided by means of a known photochemical method. A film 5 is provided across the luminescent layer by spraying with an organic lacquer. The film 5 also covers the upright edge 2 in the places denoted by 6 and 7. The metallization is afterwards vapour-deposited on the film 5 and in the stage of the manufacture shown it is not yet present. In order to prevent the metallization from forming a homogeneous non-porous layer at 6 and 7, as a result of which the film, upon subsequent firing, would produce blisters and chips in the metallization, the upright edge 2 is blasted on the inside with a fine-granular material. For that purpose the nozzle 8 is used. The face plate is for that purpose arranged so as to be rotatable about an axis normal to the center of the face plate. The distance from the orifice of the nozzle 8 to the inside of the edge 2 is maintained approximately constant. However, this distance is not critical because the circumference 9 of the luminescent layer 4 need not be followed accurately. All kinds of material may be used for the fine-granular material. Good results have been obtained inter alia with powdered ammonium bicarbonate, as well as with ammonium carbonate, metacrylate resin and polyvinyl alcohol.

What is claimed is:

1. A method of metallizing a screen having a luminescent layer, comprising the steps of providing on said luminescent layer a film that can be fired, roughening parts of said film extending beyond said luminescent layer by blasting with a fine granular material, then metallizing by vapour deposition said film and firing said film so as to remove substantially said film.

2. A method as recited in claim 1, wherein residues of the fine-granular material are removed by means of a thermal treatment.

* * * * *